United States Patent [19]

Kohls et al.

[11] Patent Number: 4,706,821

[45] Date of Patent: Nov. 17, 1987

[54] MERCHANDISE DISPLAY AND DISPENSING DEVICE

[75] Inventors: Mitchell L. Kohls, Greenfield, Wis.; Loren G. Smith, St. Paul; H. David Zahringer, Minneapolis, both of Minn.

[73] Assignee: Jockey International, Inc., Kenosha, Wis.

[21] Appl. No.: 887,065

[22] Filed: Jul. 17, 1986

[51] Int. Cl.[4] ..... A47E 7/00

[52] U.S. Cl. ..... 211/593; 312/114

[58] Field of Search ..... 211/59.3, 43, 184, 162, 211/94, 51; 312/71, 114; 221/279; 411/534

[56] References Cited

U.S. PATENT DOCUMENTS

| | | | |
|---|---|---|---|
| 1,368,473 | 2/1921 | Beatty | 411/534 |
| 2,110,299 | 3/1938 | Hinkle | 211/59.3 |
| 2,140,656 | 12/1938 | Smith | 211/43 |
| 2,872,266 | 2/1959 | Holderle et al. | 312/114 X |
| 3,083,067 | 3/1963 | Vos et al. | 312/71 |
| 4,255,001 | 3/1981 | Frishman | 312/114 |

FOREIGN PATENT DOCUMENTS

| | | | |
|---|---|---|---|
| 611044 | 9/1926 | France | 211/43 |

*Primary Examiner*—Ramon S. Britts
*Assistant Examiner*—Sarah A. Lechok Eley
*Attorney, Agent, or Firm*—Willian Brinks Olds Hofer Gilson & Lione Ltd.

[57] ABSTRACT

A merchandise display and dispensing device includes a frame which carries at least one shelf. The shelf defines a slot, and the shelf supports a pushplate which includes an upstanding section and a guide section oriented parallel to the shelf. The pushplate is disposed on the shelf over the slot. Four low friction glides are mounted to the guide section of the pushplate to bear on an upper planar surface of the shelf to support the pushplate on the shelf and to reduce sliding friction therebetween. First and second guide pins are mounted to the pushplate to extend through the slot and thereby guide sliding motion of the pushplate on the shelf. The guide pins have enlarged heads sized to bear against the lower surface of the shelf to hold the pushplate in place. A spring is mounted between the pushplate and the shelf to bias the pushplate toward a first end of the slot.

11 Claims, 5 Drawing Figures

MERCHANDISE DISPLAY AND DISPENSING DEVICE

BACKGROUND OF THE INVENTION

The present invention relates to merchandise display and dispensing devices of the type which include a pushplate biased to push the merchandise being displayed forwardly, toward the customer.

U.S. Pat. No. 3,083,067 to Vos discloses one merchandise display and dispensing device which has proven successful in a variety of applications over a considerable time period. The device of the Vos patent includes a frame on which are mounted a number of shelves. Each shelf is divided into a plurality of compartments by upstanding dividers, and a number of pushplates are recessed in openings defined in the shelves to slide in respective tongue-in-groove guides. These pushplates are biased forwardly by coil springs which urge the pushplates and the merchandise supported by the pushplates toward the front of the frame.

In spite of their many advantages, devices of the type shown in the Vos patent are not well suited for fabrication in modern acrylic plastics. In particular, acrylic plastics can generate large frictional forces which can interfere with the proper sliding operation of the pushplates. The present invention is directed to improved versions of display and dispensing devices of the type shown in the Vos patent, which can readily be constructed from modern acrylic plastics and which minimize frictional forces associated with movement of the pushplates.

SUMMARY OF THE INVENTION

According to this invention, a merchandise display and dispensing device of the type comprising a frame which comprises at least one shelf and a plurality of dividers mounted adjacent to the shelf to divide the shelf into a plurality of compartments is provided with at least one pushplate which comprises an upstanding section and a guide section oriented parallel to the shelf. The pushplate is disposed on the shelf over a slot defined in the shelf between a pair of the dividers such that the pushplate itself is situated between the dividers. A plurality of low friction glides are interposed between the pushplate and an upper surface of the shelf to support the pushplate on the shelf and to reduce sliding friction between the shelf and the pushplate. At least one guide pin is mounted to the pushplate to extend through the slot and thereby to guide sliding movement of the pushplate on the shelf. The guide pin has an enlarged head sized to bear against the shelf to hold the pushplate in place. A spring is mounted between the pushplate and the shelf to bias the pushplate toward a first end of the slot.

This invention provides important advantages. It is well adapted for fabrication of a sheet plastic material such as transparent acrylic plastic. The combination of the guide pins and the low friction glides minimizes sliding resistance between the pushplate and the shelf, and it allows the use of springs which develop a light spring force in use. The transparent acrylic sheet material provides an attractive display which allows the packaging and colors of the merchandise stored in the dispensing device to be seen from all sides, thereby attracting the attention of consumers. Furthermore, because heavy spring forces have been avoided, the consumer can readily remove and replace packages on the shelves without difficulty.

The invention itself, together with further objects and attendant advantages, will best be understood by reference to the following detailed description, taken in conjunction with the accompanying drawings.

DETAILED DESCRIPTION OF THE PRESENTLY PREFERRED EMBODIMENTS

Figure 2:
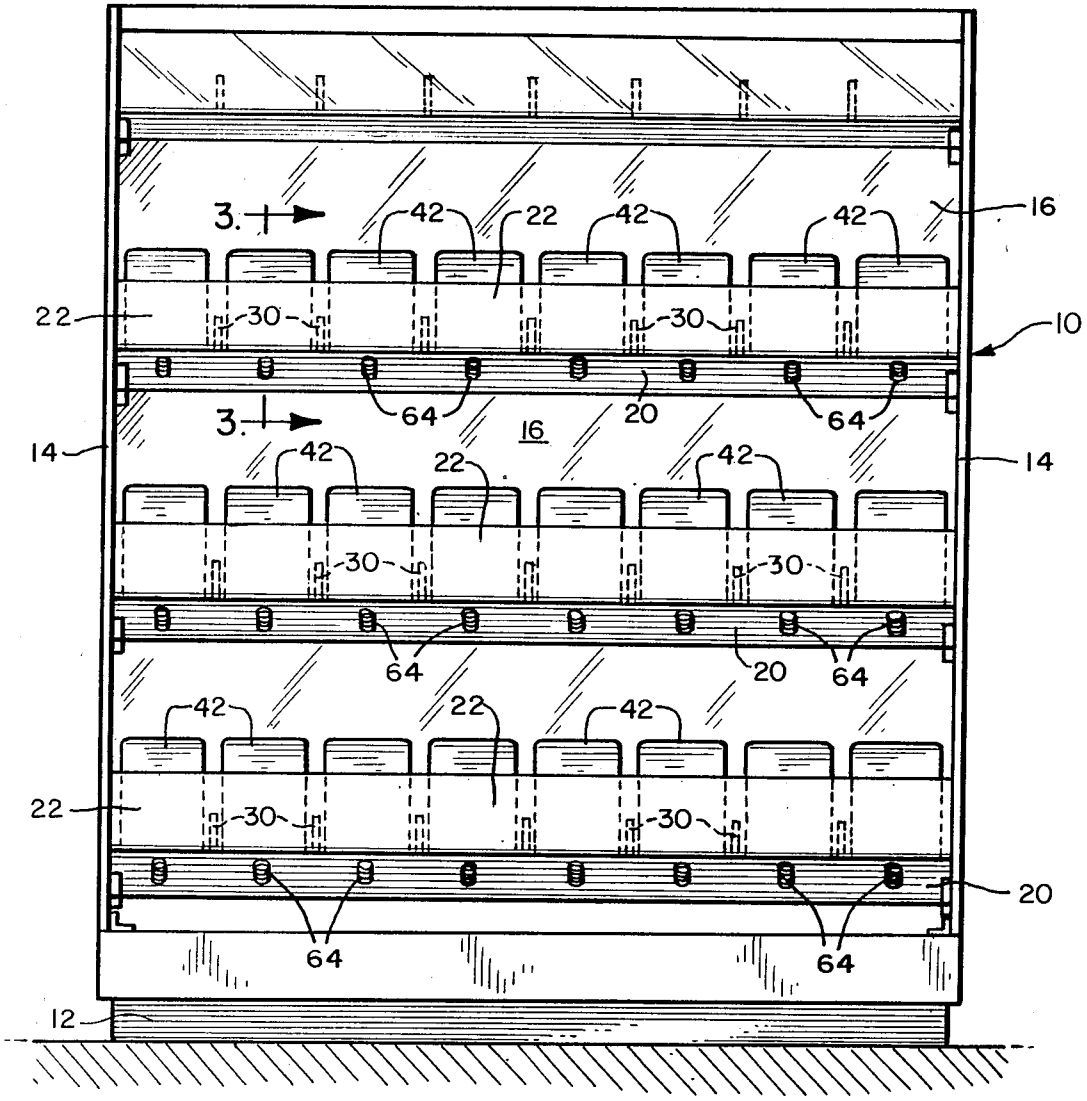
FIG. 2 is a front elevational view of the embodiment of FIG. 1, taken along line 2—2 of FIG. 1.
Figure 1:
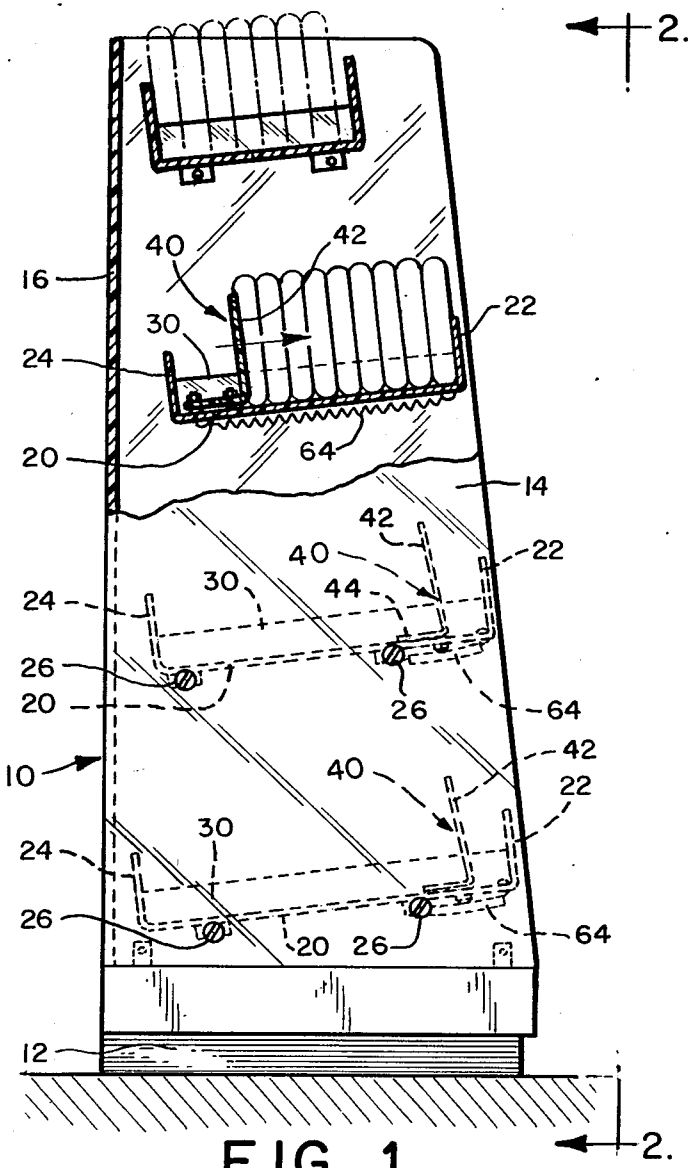
FIG. 1 is a side elevational view of a presently preferred embodiment of the display and dispensing device of this invention.

Turning now to the drawings, FIGS. 1–5 show various views of a presently preferred embodiment 10 of this invention. As shown in FIGS. 1 and 2, this embodiment 10 includes a base 12 to which is mounted a pair of upstanding, parallel side walls 14. If desired, the rigidity of the device can be increased by installing a rear wall 16 which extends between and is secured to the side walls 14. Any suitable material can be used for the base 12, the side walls 14 and the rear walls 16. However, in this preferred embodiment, the side walls 14 and the rear walls 16 are preferably formed of clear acrylic sheet material in a thickness of $\frac{3}{8}''$. The walls 14,16 can be connected to the base 12 in any suitable manner, as for example with the use of L brackets, or by bending the lower edge of the walls 14,16 inwardly and attaching these inwardly projecting portions of the walls 14,16 to the base 12 with suitable fasteners.

As best shown in FIGS. 1 and 2, a plurality of shelves 20 are mounted to extend between the side walls 14. In this embodiment, the shelves 20 are secured to the side walls 14 by means of fasteners 26. One approach is to provide each of the shelves 20 with a downardly extending flange adjacent the respective side wall 14, and to secure these flanges to the side walls 14 with the fasteners 26. Of course, other types of fastening arrangements can also be used, such as Lexan fasteners passing through the shelves 20 and the walls 14.

Figure 3:
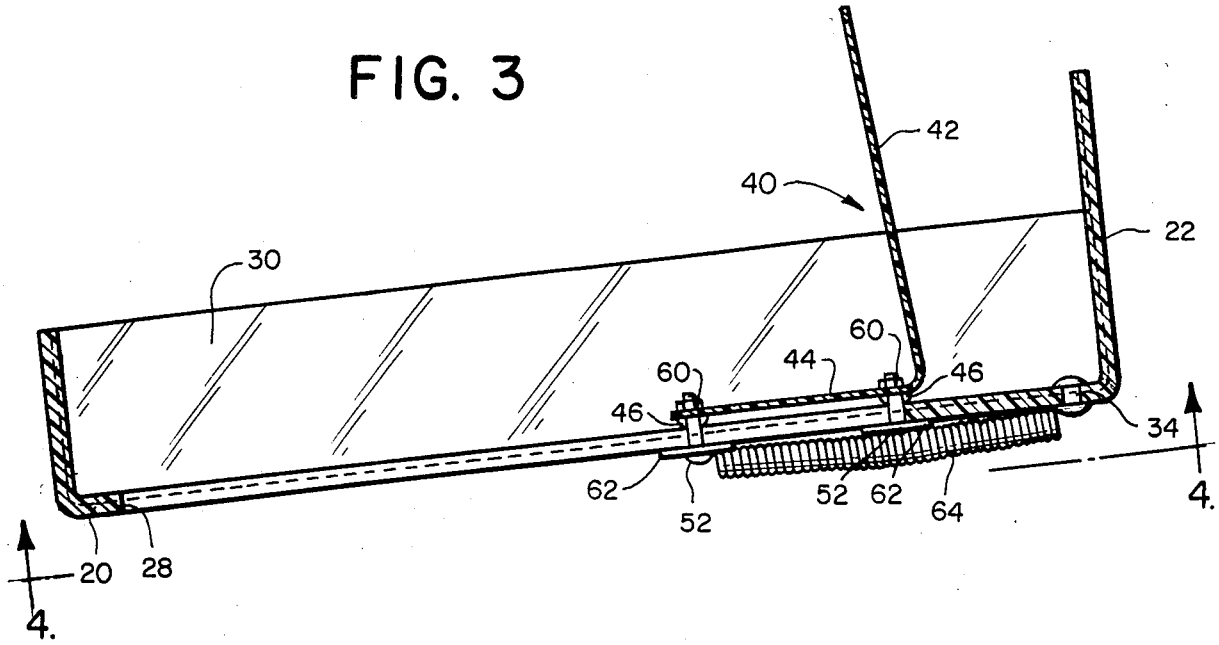
FIG. 3 is a sectional view taken along line 3—3 of FIG. 2.

As best shown in FIG. 3, each of the bottom three shelves 20 of the embodiment of FIGS. 1–5 includes integrally formed front and rear walls 22,24. In this embodiment, the shelves 20 are each formed of $\frac{1}{4}''$ thick clear acrylic sheet material and the front and rear walls 22,24 are simply folded upwardly to the configuration shown in FIG. 3. Each of the shelves 20 defines an array of parallel slots 28 extending between the front and rear walls 22,24. In addition, a plurality of dividers 30 are mounted to each of the shelves 20 so as to divide each of the shelves 20 into a plurality of compartments. These dividers 30 extend parallel to the slots 28, and in general each of the inner slots 28 is centered between a respective pair of the dividers 30. Any suitable means can be provided for mounting the dividers 30 in place, such as the grooves in the shelves 20 and walls 22,24 shown in FIGS. 3 and 4. The dividers 30 can be formed of any suitable material, but in this preferred embodiment, each of the dividers 30 is formed from a sheet of clear acrylic material $\frac{1}{8}$" in thickness.

Figure 4:
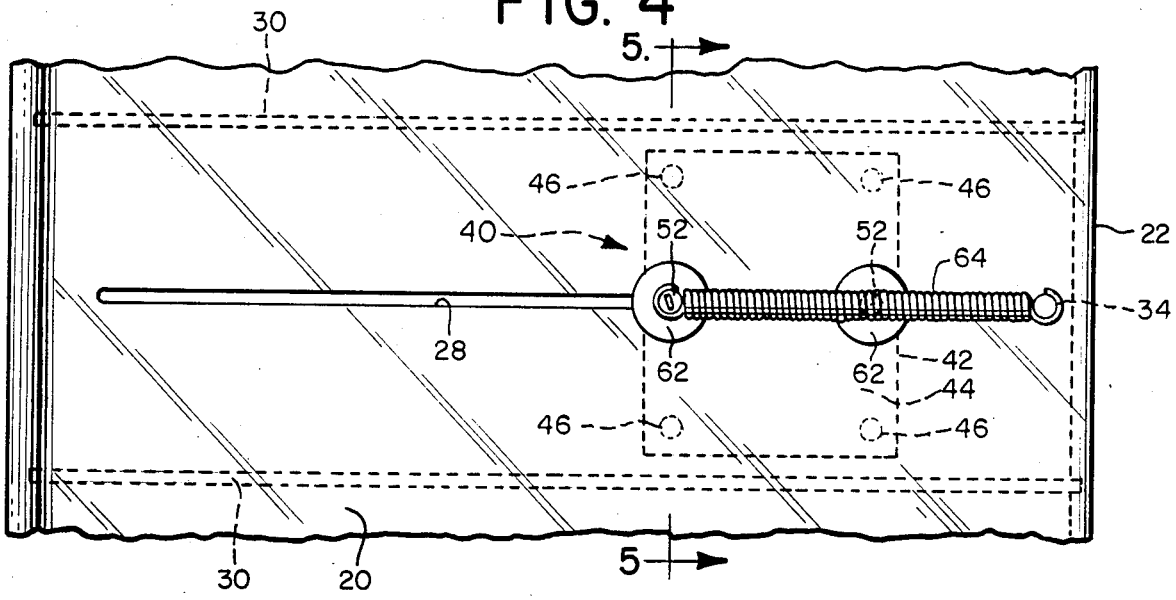
FIG. 4 is a fragmentary bottom view taken along line 4—4 of FIG. 3.
Figure 5:
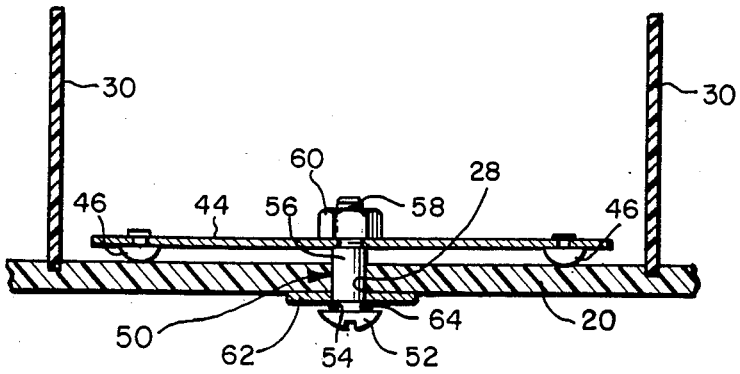
FIG. 5 is a sectional view taken along line 5—5 of FIG. 4.

As best shown in FIGS. 3–5, a plurality of pushplates 40 are mounted to slide on the shelves 20. Each of these pushplates 40 defines an upstanding portion 42 and a guide portion 44, and the guide portions 44 are oriented generally parallel to the central portion of the shelves 20.

Each guide portion 44 supports four spaced glides 46 which are formed of a low friction material adapted to slide directly on the upper planar surface of the shelf 20 with a minimum of friction. As shown in FIG. 4, two of the glides 46 are positioned on each side of the respective slot 28. Thus, the pushplates 40 are supported by the upper surface of the shelf 20, and no part of the pushplate 40 or the glides 46 is disposed below the upper surface of the shelf 20.

As shown in FIGS. 3–5, the pushplates 40 are guided in movement and held in place by a pair of guide pins 50. FIG. 5 shows a sectional view of one of these guide pins 50, which includes a head 52, a recess 54, a shank 56, a shoulder 57, and a threaded end 58. Each of the guide pins 50 is secured to the guide portion 44 of the pushplate 40 by a respective threaded nut 60 such that the shoulder 57 bears on the underside of the guide portion 44. The guide pins 50 are dimensioned such that the shank 56 is aligned with the side walls of the slot 26. A friction-reducing washer 62 is interposed between the head 52 of the guide pin 50 and the lower surface of the shelf 20. Thus, the guide pins 50 prevent the pushplate 40 from twisting with respect to the slot 28, and the guide pins 50 limit the pushplate 40 to movement along a sliding axis which extends in the direction of the slot 28. The friction-reducing washers 62 cooperate with the glides 46 to minimize sliding friction between the pushplate 40 and the shelf 20.

As shown in FIGS. 3–5 a coil spring 64 is mounted at one end to the guide pin 50 nearer the rear wall 24 and at the other end to a spring attachment fastener 34 which is secured to the shelf 20 near the front wall 22. This spring 64 passes directly under the other of the two guide pins 50. The spring 64 defines a loop at each end which is sized to be received by the recess 54 of the rearward guide pin 50.

In order better to define the best mode of the present invention, the following details of construction are provided. It is of course intended that these details be regarded merely as illustrative, and in no way limiting the scope of the appended claims.

In this embodiment the pushplate 40 is stamped from 16 gauge cold rolled steel, and the upstanding portion 42 is sized for the particular product intended to be displayed and dispensed. In this embodiment, the upstanding portion 42 is 5 inches high and 4 inches wide. The glides 46 of this embodiment are clips formed of injection molded nylon such as those available from Fastex as part No. 254-090401-00. Each clip has a diameter of 0.141 inches and a round head that acts as the gliding surface. The guide pins 50 of this embodiment are machined from mild steel and are 1" in length and 0.25" in diameter at the shank 56. In this embodiment the washers 62 are 1 inch in outside diameter and 0.25 inches in inside diameter and are formed of a plastic such as high density polyethylene. The spring 64 is preferably formed of galvanized hard-drawn spring steel 0.033 inches in diameter. The overall diameter of the spring 64 is preferably 0.350 inches and the body length is preferably 4.1 inches. Preferably, the spring 64 provides a spring force of 14 oz. when the pushplate 40 is in its forwardmost position, and 5 pounds 6 ounces when the pushplate 40 is in its rearwardmost position. Preferably, the shelf 20 is provided with thermally formed lips or walls 22,24 and all edges are machine finished and flame polished. The depth of the shelves varies from the lowest to the highest positions.

The embodiment 10 described above is used in much the same way as the device of the above-referenced U.S. Pat. No. 3,083,067. In particular, packages to be displayed are loaded onto the shelves 20 after first moving the pushplate 40 rearwardly, thereby extending the spring 64. After the packages have been loaded on the shelf 20 the pushplate 40 is then released. As packages are removed from the shelf 20, the spring 64 moves the pushplate 40 forwardly, thereby maintaining the packages supported by the shelf 20 in a neat and orderly array.

The embodiment described above provides important advantages. The above-described arrangement of glides and guide pins has been found to minimize sliding friction of the pushplate, and thereby to allow the use of a spring with a low spring force. This simplifies operation of the pushplate by the consumer. Furthermore, the pushplate arrangement described above allows the shelves 20 to be formed of plastic materials such as transparent acrylic sheet materials. As explained above, such materials provide important marketing advantages in that they allow the packaging of the product and the product itself to be seen from all sides, and they minimize the bulk of the dispensing device.

Of course, it will be apparent that a wide range of changes and modifications can be made to the preferred embodiment described above. It is therefore intended that the foregoing detailed description be regarded as illustrative rather than limiting, and that it be understood that it is the following claims, including all equivalents, which are intended to define the scope of this invention.

We claim:

1. In a merchandise display and dispensing device of the type comprising a frame which comprises at least one shelf and a plurality of dividers mounted adjacent to the shelf to divide the shelf into a plurality of compartments, the improvement comprising:

a slot defining portion of the shelf which defines a slot in the shelf situated between a pair of the dividers, said slot defining portion defining a transparent upper surface;

a pushplate comprising an upstanding section and a guide section oriented parallel to the shelf, said pushplate disposed on the upper surface over the slot between the pair of dividers;

a plurality of low friction glides fixedly secured to the pushplate to bear on the upper surface of the shelf to support the pushplate on the shelf and to slide on the upper surface to reduce sliding friction therebetween;

a pair of guide pins mounted to the pushplate and extending through the slot to guide sliding motion of the pushplate on the shelf, at least one of said guide pins having an enlarged head sized to bear against the shelf to hold the pushplate in place; and spring means disposed beneath the shelf and coupled to the pushplate through the slot biasing the pushplate toward a first end of the slot.

2. The invention of claim 1 wherein the spring means comprises a coil spring secured at one end to one of the guide pins under the shelf and at the other end to the lower surface of the shelf at an attachment point.

3. The invention of claim 2 wherein the one of the guide pins and the attachment point are arranged on a sliding axis aligned wiht the slot, and wherein the other guide pin is disposed in the slot between the first guide pin and the attachment point.

4. The invention of claim 3 further comprising a low friction element disposed between the enlarged head of the guide pin and the shelf to reduce sliding friction therebetween.

5. The invention of claim 4 wherein the shelf is formed of a clear acrylic sheet material, and wherein the glides and the low friction elements are formed of low friction plastic materials.

6. In a merchandise display and dispensing device of the type comprising a frame which comprises at least one shelf and a plurality of dividers mounted adjacent to the shelf to divide the shelf into a plurality of compartments, the improvement comprising:

a plurality of linear slots defined in the shelf, each positioned between an adjacent pair of the dividers;

a plurality of spring attachment points, each positioned on an underside of the shelf aligned with a respective one of the slots;

a plurality of pushplates, each comprising an upstanding section and a guide section oriented parallel to the shelf, each of said pushplates positioned over a respective one of the slots between the respective pair of the dividers;

a plurality of sets of four low friction glides, each set mounted to the guide section of the respective pushplate to slide on an upper surface of the shelf such that two of each set of glides are positioned on one side of the respective slot and two of each set of glides are positioned on the other side of the respective slot, said glides effective to reduce sliding friction between the pushplates and the shelf;

a plurality of first guide pins, each mounted to the respective pushplate to extend through the respective slot and engage the lower surface of the shelf to hold the respective pushplate in place while allowing the pushplate to slide across the shelf;

a plurality of second guide pins, each mounted to the respective pushplate to extend through the respective slot and engage the lower surface of the shelf to hold the respective pushplate in place while allowing the pushplate to slide across the shelf, each of said second guide pins disposed between the respective first guide pin and the respective spring attachment point; and a plurality of coil springs, each mounted under the shelf with one end secured to the respective first guide pin and the other end secured to the respective spring attachment point such that each spring passes under the respective second guide pin, said coil springs effective to bias the pushplates toward the spring attachment points.

7. The invention of claim 6 further comprising a plurality of low friction elements, each disposed between the shelf and a respective one of the guide pins to reduce sliding friction therebetween.

8. The invention of claim 6 wherein the shelf is formed of a clear acrylic sheet material, and wherein the glides and the low friction elements are formed of low friction plastic materials.

9. In a merchandise display and dispensing device of the type comprising a frame which comprises at least one shelf and a plurality of dividers mounted adjacent to the shelf to divide the shelf into a plurality of compartments, the improvement comprising:

a slot defining portion of the shelf which defines a slot in the shelf situated between a pair of the dividers;

a pushplate comprising an upstanding section and a guide section oriented parallel to the shelf, said pushplate disposed on the shelf over the slot between the pair of dividers;

a plurality of low friction glides interposed between the pushplate and an upper surface of shelf to support the pushplate on the shelf and to reduce sliding friction therebetween;

first and second guide pins mounted to the pushplate and extending through the slot to guide sliding motion of the pushplate on the shelf, at least one of said guide pins having an enlarged head sized to bear against the shelf to hold the pushplate in place; and spring means biasing the pushplate toward a first end of the slot;

said spring means comprising a coil spring secured at one end to said first guide pin under the shelf and at the other end to the lower surface of the shelf at an attachment point;

said first guide pin and the attachment point being arranged on a sliding axis aligned with the slot, and said second guide pin disposed in the slot between the first guide pin and the attachment point.

10. The invention of claim 9 further comprising a low friction element disposed between the enlarged head of the guide pin and the shelf to reduce sliding friction therebetween.

11. The invention of claim 10 wherein the shelf is formed of a clear acrylic sheet material, and wherein the glides and the low friction elements are formed of low friction plastic materials.

* * * * *